US007645553B2

(12) United States Patent
Matsumura et al.

(10) Patent No.: US 7,645,553 B2
(45) Date of Patent: Jan. 12, 2010

(54) IMAGE FORMING METHOD USING TONER HAVING BLOCK COPOLYMER

(75) Inventors: Yasuo Matsumura, Kanagawa (JP); Hirotaka Matsuoka, Kanagawa (JP); Hideo Maehata, Kanagawa (JP); Satoshi Hiraoka, Kanagawa (JP); Yuki Sasaki, Kanagawa (JP); Fumiaki Mera, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 371 days.

(21) Appl. No.: 11/352,362

(22) Filed: Feb. 13, 2006

(65) Prior Publication Data

US 2007/0092823 A1 Apr. 26, 2007

(30) Foreign Application Priority Data

Oct. 24, 2005 (JP) ..... 2005-308042

(51) Int. Cl.
*G03G 15/20* (2006.01)

(52) U.S. Cl. ..... 430/124.1; 430/124.23; 430/124.3

(58) Field of Classification Search ..... 430/124.1, 430/124.23, 124.3
See application file for complete search history.

(56) References Cited

U.S. PATENT DOCUMENTS

| | | | | |
|---|---|---|---|---|
| 4,385,107 | A * | 5/1983 | Tanaka et al. | 430/124.23 |
| 4,940,644 | A * | 7/1990 | Matsubara et al. | 430/109.4 |
| 6,632,883 | B2 | 10/2003 | Mayes et al. | |
| 2004/0132920 | A1* | 7/2004 | Matsumura et al. | 525/418 |
| 2004/0137350 | A1* | 7/2004 | Yamazaki et al. | 430/108.7 |
| 2004/0137354 | A1* | 7/2004 | Yamazaki et al. | 430/109.4 |
| 2004/0152006 | A1* | 8/2004 | Teshima | 430/109.4 |
| 2005/0100807 | A1* | 5/2005 | Yamazaki et al. | 430/108.6 |
| 2005/0158088 | A1* | 7/2005 | Someya et al. | 399/328 |
| 2006/0088349 | A1* | 4/2006 | Someya et al. | 399/328 |

FOREIGN PATENT DOCUMENTS

| | | | |
|---|---|---|---|
| JP | A 63-282752 | | 11/1988 |
| JP | A 6-250439 | | 9/1994 |
| JP | A 8-325362 | | 12/1996 |
| JP | A 9-143253 | | 6/1997 |
| JP | A 10-1536 | | 1/1998 |
| JP | A 2002-351140 | | 12/2002 |
| JP | 2004138922 | A * | 5/2004 |
| JP | 2004264615 | A * | 9/2004 |
| JP | 2004264616 | A * | 9/2004 |
| JP | 2004264617 | A * | 9/2004 |
| JP | 2004294735 | A * | 10/2004 |
| JP | 2004294736 | A * | 10/2004 |
| JP | 2004294737 | A * | 10/2004 |
| JP | 2005275235 | A * | 10/2005 |

OTHER PUBLICATIONS

Diamond, Arthur S & David Weiss (eds.) Handbook of Imaging Materials, 2nd ed.. New York: Marcel-Dekker, Inc. (Nov. 2001) pp. 145-164.*

Takayoshi Aoki, "Chemical Toner Technology and The Future" IS&T's NIP19. Springfield, Virginia: The Society for Imaging Science & Technology. (2003) pp. 2-4.*

English Language Machine Translation of JP 2004-138921 (May 2004).*

English Language Machine Translation of JP 2005-275235 (Oct. 2005).*

* cited by examiner

*Primary Examiner*—Christopher RoDee
(74) *Attorney, Agent, or Firm*—Oliff & Berridge, PLC

(57) ABSTRACT

An image forming method, which comprises: forming an electrostatic latent image on a surface of a latent image supporting member; developing the electrostatic latent image formed on the surface of the latent image supporting member with a toner for developing an electrostatic latent image or an electrostatic latent image developer containing the toner and a carrier to form a toner image; transferring the toner image formed on the surface of the latent image supporting member onto a surface of a transfer receiving material; and fixing the toner image transferred onto the transfer receiving material under pressure, wherein the toner comprises a block copolymer having a crystalline polyester block and a non-crystalline polyester block, and wherein a maximum pressure applied when the image is fixed is 1 MPa or greater but not greater than 10 MPa.

13 Claims, No Drawings

IMAGE FORMING METHOD USING TONER HAVING BLOCK COPOLYMER

BACKGROUND OF THE INVENTION

1. Field of the Invention

The present invention relates to an image forming method by electrophotography or electrostatic recording method. In addition, the present invention relates to a production process of a toner for developing an electrostatic latent image suited for use in the image forming method.

2. Description of the Related Art

A visualizing method of image information via an electrostatic latent image in electrophotography or the like is widely utilized now in various fields. In the electrophotography, an electrostatic latent image is formed on a photoreceptor (latent image supporting member) through charging and exposure steps, the electrostatic latent charge is developed with a developer containing a toner, and the developed image is then visualized through transfer and fixing steps. There are two types of developers used in the above-described steps, that is, a two-component developer composed of a toner and a carrier, and a one-component developer composed singly of a magnetic toner or non-magnetic toner. For the preparation of the toner, a kneading-pulverizing process which comprises melt kneading a thermoplastic resin with a pigment, a charge controller, and a release agent such as wax, cooling the kneaded mass, pulverizing it into fine particles, and then classifying the particles. If necessary, for the purpose of improving fluidity and cleaning property of the thus prepared toner, inorganic and/or organic particles may be added to the surface to the toner particles.

Although copier and printer making use of color electrophotography, and multifunction machine having a function of facsimile in addition spread widely, it is usually very difficult to use a release agent such as wax when adequate gloss and transparency for obtaining excellent OHP image are desired in the reproduction of a color image. A large amount of oil is fed to a fixing roll in order to attain good release, which however makes a copied image including OHP sticky or disturbs additional recording to an existing image by a pen. Moreover, it sometimes causes uneven gloss. Waxes ordinarily used for black-and-white copy such as polyethylene, polypropylene and paraffin damage the OHP transparency so that they are more unsuited for use.

Even though the transparency is sacrificed, it is difficult to suppress exposure of a wax on the surface when a toner prepared using the conventional kneading and pulverizing process is employed. Use of such a toner as a developer causes problems such as considerable deterioration in fluidity and filming on a developing machine and a photoreceptor.

As a fundamental method for overcoming the above-described problems, proposed is a production process of a toner by dispersing an oil phase composed of a raw material for a resin and a colorant in an aqueous phase, followed by direct polymerization, whereby the wax is included in the toner to suppress exposure thereof on the surface.

Furthermore, as a method for intentionally controlling the shape and the surface structure of a toner, production processes of a toner by the emulsion polymerization and aggregation method are proposed in JP-A-63-282752 and JP-A-6-250439. In these production processes, a toner is produced by preparing a resin particle dispersion usually by emulsion polymerization, preparing separately a colorant dispersion by dispersing a colorant in a solvent, mixing these dispersions to form aggregates having a diameter corresponding to the particle size of the toner, and then heating the aggregates to cause fusion and coalescence thereof.

These production processes not only realize inclusion of wax, but also facilitate decrease in the diameter of a toner and enable reproduction of an image with high resolution and high sharpness.

As described above, in order to provide a high quality image through the electrophotographic process and to maintain the stable performance of a toner under various kinds of mechanical stress, it is very important to select proper pigment and release agent, optimize their amounts and suppress exposure of the release agent on the surface. It is also very important to improve the gloss and releasing property in the absence of a fixing oil, and suppress a hot offset phenomenon by optimization of the characteristics of the resin.

A technology capable of fixing a toner at lower temperature is desired in order to reduce the energy consumption amount. Particularly in recent years, it is desired for thorough energy saving to stop the current passage through a fixing device when it is not used. Accordingly, the temperature of the fixing device is required to be elevated to a use temperature immediately after the current application. To this end, a heat capacity of the fixing device is preferably as small as possible. In this case, however, a difference in the temperature of the fixing device tends to increase more than as usual. This means that the overshoot of the temperature after current application increases, while the temperature drastically decreases owing to the passage of paper. Further, when a sheet of paper having a width smaller than that of the fixing device is continuously fed a difference in temperature between a paper passage portion and a non-paper-passage portion also increases. Especially, in a high-speed copier or printer, owing to shortage in a power capacity, there tends to occur such a tendency. Accordingly, there is a strong demand for the development of a toner having so-called wide fixing latitude, that is, a toner which can be fixed at low temperature and does not generate offset even in a high temperature region.

In order to decrease the fixing temperature of a toner, the use of a polycondensation type crystalline resin which exhibits a sharp melting behavior, depending on the temperature, as a binder resin constituting the toner is known. The toner using a crystalline resin tends to cause yield deformation. When the crystalline resin is used for the formation of a toner in practice, troubles such as filming on a photoreceptor due to crushing of the toner or lowering in the transfer efficiency with the passage of time cannot be avoided.

Use of a crystalline resin and a non-crystalline resin in combination is inevitable for attaining low temperature fixing property, prevention of filming on a photoreceptor and good transferring property simultaneously. Especially, a non-crystalline resin is requested to have a high performance.

When a toner is prepared by the emulsion polymerization and aggregation method as described above, it is possible to polymerize a polycondensation type resin, emulsify the polymer in a water based medium, aggregate the resulting latex together with a pigment and wax and then cause fusion and coalescence of the aggregate.

Emulsification of a polycondensation resin however requires a non-efficient and large energy consuming step such as emulsification by high shearing under heat exceeding even 150° C. or removal of a solvent after a solution having a viscosity reduced by dissolving in a solvent is dispersed in a water based medium.

In addition, it is difficult to avoid problems such as hydrolysis during the emulsification in a water based medium and occurrence of uncertain factors in material design is inevitable.

Polycondensation of a polyester resin proceeds by dehydration reaction, but an increase in molecular weight sometimes stops as the progress of the polymerization. This is presumed to occur because a viscosity of the system increases and when it reaches a predetermined value, dehydration does not occur easily. Compared with a crystalline resin which has a melting temperature and shows a drastic decrease in the resin viscosity at its melting temperature or greater, an amorphous condensation resin is highly viscous even at a temperature of Tg or greater. Reaction under severe conditions, for example, reaction for 10 hours or greater at high temperature exceeding 200° C., under stirring with a large power under high vacuum are necessary for polyester polymerization and it leads to large energy consumption. An enormous equipment investment is often required to attain durability of the reaction equipment.

Moreover, aromatic-ring-containing monomers mainly used for an amorphous polyester have low reactivity at low temperatures so that preparation of a polyester resin having a large number of rigid aromatic rings introduced in the unit thereof needs temperature conditions exceeding 150° C. An enormous equipment investment is often required to attain durability of the reaction equipment.

For example, in JP-A-2002-351140, proposed is a production process of a toner for developing an electrostatic latent image, characterized in that a raw material for toner containing at least a polyester resin is melted by heating, the melted raw material is emulsified in a water based medium to form resin fine particles, and the resin fine particles are aggregated and then fused to prepare an aggregate of the resin fine particles.

In the above-described document, a conventional polycondensation catalyst such as tetrabutyl titanate is employed as a catalyst. The monomer employed is a polycarboxylic acid such as trimellitic anhydride (TMA), a dicarboxylic acid such as terephthalic acid (TPA) and isophthalic acid (IPA), an aromatic diol such as polyoxypropylene (2,4)-2,2-bis(4-hydroxyphenyl)propane (BPA-PO) or polyoxyethylene (2.4)-2,2-bis(4-hydroxyphenyl)propane (BPA-EO) or an aliphatic diol such as ethylene glycol (EG). Reaction is effected at 220° C. for 15 hours under a normal pressure in a nitrogen gas stream, followed by gradual reduction in pressure. The reaction is then effected at 10 mmHg, whereby a polyester resin having a weight average molecular weight of from about 5,000 to 90,000 is prepared. The resulting polyester resin is melted and kneaded with a colorant and a wax. The kneaded mass MB1 is heated to 190° C. and poured in "Cavitron CD1010" (trade name; product of Eurotec) which is a dispersing and emulsifying machine. The kneaded mass is sent to Cavitron at a rate of 1 L/min while adding 0.5 wt. % dilute aqueous ammonia and heating to 160° C. by a heat exchanger. The dispersion slurry thus obtained is taken out after cooling it to 60° C. For preparing a toner from the resulting dispersion, aggregation, fusion, washing and drying steps are carried out subsequently. Such a process evidently needs an enormous energy for the preparation of the resin and emulsification of the resin and is therefore not suited for practical use.

In addition, emulsification and dispersion under such high energy conditions tend to cause decomposition of the resin. The resin therefore lacks uniformity in the composition and it is difficult to realize the uniform particle size distribution of the resin particles in the dispersion. Moreover, during storage of the dispersion, undesired aggregation of particles sometimes occurs, which also becomes a trouble for the practical use. The toner using such materials tends to cause problems not also in the initial image quality but also in the stability of the image quality during continuous printing.

There is also a report on the synthesis of a polycondensation resin in an organic solvent. For example, a production process of an unsaturated polyester resin by subjecting an aliphatic alcohol and an aliphatic polybasic acid to thermal dehydration reaction at from 100° C. to 200° C. in an organic solvent is described in JP-A-10-1536. In JP-A-8-325362, a production process of an aliphatic polyester resin which comprises reacting at least two aliphatic polyester homopolymers in an organic solvent in the presence of a catalyst is described. In JP-A-9-143253, an example of using lactic acid as a hydroxycarboxylic acid and polylactic acid as a polyhydroxycarboxylic acid is disclosed. In this document, ether solvents, halogenated hydrocarbon solvents and hydrocarbon solvents are exemplified as an organic solvent.

The technologies disclosed in the above-described documents are all related to an aliphatic polyester resin. It has been found that such resins using an aliphatic monomer are not suited for practical use at all as a resin for toner because their glass transition point is not greater than room temperature. In addition, the main object of the production process as disclosed in JP-A-9-143253 is to give biodegradability to the resin, which has no relation with the fixing property of a toner which is a technical object of the invention. In short, no suggestion useful for solving the problems of the resin for a toner is given by these disclosed technologies.

When thick paper is used as a transfer receiving material, thermal energy spent for the paper becomes large, which leads to such problems as easy change in the temperature of a fixing roll, irregular temperature distribution in the same sheet of paper or between sheets of paper and a difference in the gloss of image. Such problems become eminent at high-speed fixing and deterioration in image quality becomes a problem.

There is accordingly a demand for the development of an image forming method which can fix an image at normal temperature or by heating at low temperature, can attain uniform gloss even when thick paper specialized in a graphic art region is used, and requires reduced energy consumption.

SUMMARY OF THE INVENTION

The invention is focused on overcoming of various problems which the related art has. The invention provides a highly reliable image forming method which can fix an image at normal temperature or by low temperature heating and form a high quality image. The present invention also provides a production process of a toner for developing an electrostatic latent image which can be used preferably in the above-described image forming method.

The above-described objects can be attained by the following means.

An image forming method, which comprises:

forming an electrostatic latent image on a surface of a latent image supporting member;

developing the electrostatic latent image formed on the surface of the latent image supporting member with a toner for developing an electrostatic latent image or an electrostatic latent image developer containing the toner and a carrier to form a toner image;

transferring the toner image formed on the surface of the latent image supporting member onto a surface of a transfer receiving material; and fixing the toner image transferred onto the transfer receiving material under pressure, wherein the toner comprises a block copolymer having a crystalline polyester block and a non-crystalline polyester block, and wherein a maximum pressure applied when the image is fixed is 1 MPa or greater but not greater than 10 Mpa. And A production process of a toner for developing an electrostatic latent image, the production process comprising:

aggregating, in a dispersion containing resin particles that comprises: a block copolymer having a crystalline polyester block and a non-crystalline polyester block; and release agent particles, the resin particles and the release agent particles, so as to obtain aggregated particles; and heating the aggregated particles to fuse into a coalescent body, wherein the block copolymer is obtained by polymerization at 150° C. or less with a sulfur-containing Bronsted acid as a catalyst.

DETAILED DESCRIPTION OF THE INVENTION

An image forming method according to the invention comprises forming an electrostatic latent image on the surface of a latent image supporting member, developing the electrostatic latent image formed on the surface of the latent image supporting member with a toner for developing an electrostatic latent image or an electrostatic latent image developer containing the toner and a carrier to form a toner image; transferring the toner image formed on the surface of the latent image supporting member onto a surface of a transfer receiving material; and fixing the toner image transferred onto the surface of a transfer receiving material under pressure; wherein the toner comprises a block copolymer having a crystalline polyester block and a non-crystalline polyester block and a maximum pressure applied for fixing the toner image is 1 MPa or greater but not greater than 10 MPa.

The present invention will next be described in detail.

(Block Copolymer)

In the invention, the toner for developing an electrostatic latent image (which will hereinafter be called electrostatic latent image developing toner) contains block copolymer having at least a crystalline polyester block and a non-crystalline polyester block. The block copolymer may contain another block in addition to a crystalline polyester block and a non-crystalline polyester block, but it is preferably composed of a crystalline polyester block and a non-crystalline polyester block.

When a crystalline resin and a non-crystalline resin constitute a block copolymer, such a resin shows a plastic behavior when pressure is applied and under at least a predetermined pressure, the resin. exhibits fluidity even at a normal temperature range. It is presumed that such a plastic fluid behavior is enhanced under light heating and resin fluidity necessary for fixing can be attained even under lower pressure. Similar phenomena was already mentioned in U.S. Pat. No. 6,632,883 (Mayes et al.), as Baroplastic behavior. The present invention is the combination of above behavior and suitable polyester block polymer preparation method to toner fixing process.

In the invention, use of a block copolymer having a crystalline polyester block and a non-crystalline polyester block makes it possible to impart the resulting toner with fluidity under at least a predetermined pressure. When the pressure is below it, the toner behaves as a solid. In the steps other than the fixing step under pressure, for example, development, transfer and cleaning steps, improvement of reliability can therefore be attained.

In particular, since a plastic fluid behavior can be attained by application of pressure, a toner image can be fixed well to thick paper which tends to have a problem of fluctuations in temperature during fixing. When a toner image is fixed to thick paper, the fixing speed must be reduced because of difficulty in high speed fixing or heating temperature must set higher, but the invention makes it possible to fix a toner image to thick paper at a fixing speed or fixing temperature similar to that employed for the fixing to thin paper.

The block copolymer having a crystalline polyester. block and a non-crystalline polyester block can be prepared by any process. Described specifically, it can be prepared by mixing a crystalline polyester resin with a non-crystalline polyester resin and subjecting the resulting mixture to a polymerization reaction; or by mixing a crystalline polyester resin with a monomer for forming a non-crystalline polyester resin and then polymerizing the mixture or vice versa. Of these, a process of obtaining a block copolymer by mixing a crystalline polyester resin with a non-crystalline polyester resin and subjecting the resulting mixture to a polymerization reaction is preferred.

The block copolymer is preferably prepared by polymerizing at 150° C. or less with a sulfur-containing Bronsted acid as a catalyst. This enables preparation of a block copolymer at low energy and is therefore preferred.

The crystalline polyester block (crystalline polyester resin) and non-crystalline polyester block (non-crystalline polyester resin) to be used in the invention can be prepared, for example, by using polycondensable monomers such as aliphatic, alicyclic, or aromatic polycarboxylic acids or alkyl ester thereof, polyols or ester compounds thereof, and hydroxycarboxylic acids and carrying out polycondensation in a water based medium by direct-esterification or ester exchange reaction.

The term "crystalline" in the "crystalline polyester" means that a polyester resin does not show a step-like endothermic change but has a clear endothermic peak in differential scanning calorimetry (DSC). More specifically, a crystalline polyester resin shows a half-width of endothermic peak within 15° C. when measured at a temperature raising rate of 10° C./min.

Resins having a half-width of endothermic peak exceeding 15° C. or those showing no clear endothermic peak are, on the other hand, non-crystalline (amorphous).

<Polyester Monomers>

Polycarboxylic acids which can be used as a polycondensable monomer for preparing the polyester resin usable in the invention are compounds having, in one molecule thereof, at least two carboxyl groups. Of these, a dicarboxylic acid has a compound having, in one molecule thereof, two carboxyl groups. Examples of it include oxalic acid, glutaric acid, succinic acid, maleic acid, adipic acid, β-methyladipic acid, azelaic acid, sebacic acid, nonanedicarboxylic acid, decanedicarboxylic acid, undecanedicarboxylic acid, dodecanedicarboxylic acid, fumaric acid, citraconic acid, diglycolic acid, cyclohexane-3,5-diene-1,2-carboxylic acid, malic acid, citric acid, hexahydroterephthalic acid, malonic acid, pimelic acid, tartaric acid, mucic acid, phthalic acid, isophthalic acid, terephthalic acid, tetrachlorophthalic acid, chlorophthalic acid, nitrophthalic acid, p-carboxyphenylacetic acid, p-phenylenediacetic acid, m-phenylenediglycolic acid, p-phenylenediglycolic acid, o-phenylenediglycolic acid, diphenylacetic acid, diphenyl-p,p'-dicarboxylic acid, naphthalene-1,4-dicarboxylic acid, naphthalene-1,5-dicarboxylic acid, naphthalene-2,6-dicarboxylic acid, anthracenedicarboxylic acid and cyclohexanedicarboxylic acid. Examples of the polycarboxylic acids other than the dicarboxylic acids include trimellitic acid, pyromellitic acid, naphthlenetricarboxylic acid, naphthalenetetracarboxylic acid, pyrenetricarboxylic acid and pyrenetetracarboxylic acid. In addition, acid anhydrides, mixed acid anhydrides, acid chlorides or esters derived from the carboxyl group of these carboxylic acids may be used.

The polyols usable in the present invention are compounds each having, in one molecule thereof, at least two hydroxyl groups. Of these, diols are compound having, in one molecule thereof, two hydroxyl groups. Examples of the diols include ethylene glycol, propylene glycol, butanediol, diethylene glycol, hexanediol, cyclohexanediol, octanediol, decanediol and dodecanediol. Examples of the polyols other than diols include glycerin, pentaerythritol, hexamethylol melamine, hexaethylol melamine, tetramethylol benzoguanamine and tetraethylol benzoguanamine.

These polyols are sparingly soluble or insoluble in a water based medium so that ester synthesis reaction proceeds in monomer droplets obtained by dispersing a polyol in a water based medium.

In the present invention, examples of the hydroxycarboxylic acid usable as a polycondensable monomer for preparing polyester resins include hydroxyheptanoic acid, hydroxyoctanoic acid, hydroxydecanoic acid and hydroxyundecanoic acid.

Non-crystalline polyester resins and crystalline polyester resins usable in the present invention can be obtained easily by using these polycondensable monomers in combination.

[Crystalline Polyester Resins]

Examples of the polycarboxylic acid to be used for the preparation of a crystalline polyester resin include, of the above-described polycarboxylic acids, oxalic acid, malonic acid, succinic acid, glutaric acid, adipic acid, pimelic acid, supelic acid, azelaic acid, sebacic acid, maleic acid, fumaric acid, citraconic acid, itaconic acid, glutaric acid, n-dodecylsuccinic acid, n-dodecenylsuccinic acid, isododecylsuccinic acid, isododecenylsuccinic acid, n-octylsuccinic acid, and n-octenylsuccinic acid, and acid anhydrides or acid chlorides thereof.

Examples of the polyol to be used for preparing a crystalline polyester resin include ethylene glycol, diethylene glycol, triethylene glycol, 1,2-propylene glycol, 1,3-propylene glycol, 1,4-butanediol, 1,4-butenediol, neopentyl glycol, 1,5-pentane glycol, 1,6-hexane glycol, 1,4-cyclohexanediol, 1,4-cyclohexanedimethanol, dipropylene glycol, polyethylene glycol and polypropylene glycol.

Crystalline polyester resins available by ring-opening polymerization of a cyclic monomer such as caprolactone are preferred because they have a crystal melting point near 60° C. which falls within a preferable range for a toner.

Examples of such a crystalline polycondensation resin include polyester resin obtained by the reaction between 1,9-nonanediol and 1,10-decanedicarboxylic acid, or between cyclohexanediol and adipic acid; polyester resin obtained by the reaction between 1,6-hexanediol and sebacic acid; polyester obtained by the reaction between ethylene glycol and succinic acid; polyester resin obtained by the reaction between ethylene glycol and sebacic acid; and polyester resin obtained by the reaction between 1,4-butanediol and succinic acid. Of these, the polyester resin obtained by the reaction between 1,9-nonanediol and 1,10-decanedicarboxylic acid and that obtained by the reaction between 1,6-hexanediol and sebacic acid are preferred.

[Non-crystalline Polyester]

Examples of the polycarboxylic acid to be used for preparing a non-crystalline polyester resin in the invention include, of the above-described polycarboxylic acids, dicarboxylic acids such as phthalic acid, isophthalic acid, terephthalic acid, tetrachlorophthalic acid, chlorophthalic acid, nitrophthalic acid, p-carboxyphenylacetic acid, p-phenyelnediacetic acid, m-phenylenediglycolic acid, p-phenylenediglycolic acid, o-phenylenediglycolic acid, diphenylacetic acid, diphenyl-p, p'-dicarboxylic acid, naphthalene-1,4-dicarboxylic acid, naphthalene-1,5-dicarboxylic acid, naphthalene-2,6-dicarboxylic acid, anthracenenedicarboxylic acid and cyclohexanedicarboxylic acid; and polycarboxylic acids other than the dicarboxylic acids such as trimellitic acid, pyromellitic acid, naphthalenetricarboxylic acid, naphthalenetetracarboxylic acid, pyrenetricarboxylic acid and pyrenetetracarboxylic acid. Moreover, anhydrides, acid chlorides or esters derived from the carboxyl group of these carboxylic acids may be used.

Of these, terephthalic acid or lower ester thereof, diphenylacetic acid and cyclohexanedicarboxylic acid are preferred. The term "lower ester" means an ester of a $C_{1-8}$aliphatic alcohol.

As the polyol to be used for preparing a non-crystalline polyester resin in the invention, use of, of the above-described polyols, polytetramethylene glycol, bisphenol A, bisphenol Z, hydrogenated bisphenol A or cyclohexanedimethanol is preferred.

As a non-crystalline resin, a polycondensate of a hydroxycarboxylic acid can be used. The hydroxycarboxylic acid is a compound having, in the molecule thereof, both a hydroxyl group and a carboxyl group. Examples of the hydroxycarboxylic acid include aromatic hydroxycarboxylic acids and aliphatic hydroxycarboxylic acids. Use of aliphatic hydroxycarboxylic acids is preferred.

Specific examples include hydroxyheptanoic acid, hydroxyoctanoic acid, hydroxydecanoic acid, hydroxyundecanoic acid and lactic acid. Of these, lactic acid is preferred.

The non-crystalline resin and crystalline resin are easily available, depending on the proper combination of the above-described polycondensable monomers.

For preparing one polycondensation resin, the above-described polycarboxylic acids and the above-described polyols each may be used either singly or in combination. The above-described polycarboxylic acids may be used singly, while the above-described polyols may be used in combination., or vise versa. When a hydroxycarboxylic acid is used for the preparation of a polycondensation resin, the above-described hydroxycarboxylic acids may be used either singly or in combination. It may be used in combination with a polycarboxylic acid or polyol.

In the block copolymer, a crystalline polyester block/non-crystalline polyester block weight ratio is from 1/20 to 20/1, more preferably from 1/10 to 10/1. A weight ratio falling within a range of from 1/9 to 5/5 is more preferred because it can suppress deterioration of the charging properties of a toner which will otherwise occur by the crystalline polyester. When the weight ratio of the crystalline polyester block and the non-crystalline polyester block falls within the above-described range, a toner obtained using the resulting block copolymer has sufficient charging properties and mechanical strength and has excellent low-temperature fixing property. The weight ratios within the above-range are therefore preferred. In addition, they are preferred because such a toner has an excellent fluid behavior under pressure.

When a block copolymer is prepared by subjecting a mixture of the crystalline polyester resin and non-crystalline polyester resin to a polymerization reaction, the crystalline polyester resin has preferably a crystal melting point of from 40 to 150° C., more preferably from 50 to 120° C., especially preferably from 50 to 90° C. When the crystalline resin having a crystal melting point within the above-described range is employed, the toner available therefrom has good blocking resistance, shows good melt fluidity even at low temperature and has good fixing property. Crystal melting points within the above-described range are therefore preferred.

The melting point of the crystalline polyester resin can be measured in accordance with differential scanning calorimetry (DSC) by using, for example, "DSC-20" (trade name; product of Seiko Instruments Inc. Described specifically, the melting point of the crystalline polyester resin can be determined as a melting peak temperature of input-compensated differential scanning calorimetry shown in JIS K-7121:87 when about 10 mg of a sample is heated from room temperature to 150° C. at a predetermined temperature raising rate (10° C./min). Although the crystalline resin sometimes exhibits a plurality of melting peaks, the maximum peak is regarded as the melting point in the invention.

When a block copolymer is prepared by subjecting a mixture of the crystalline polyester resin and non-crystalline polyester resin to a polymerization reaction, the non-crystalline polyester resin preferably has a glass transition point Tg of from 50 to 80° C., more preferably from 50 to 65° C. When the glass transition point Tg is 50° C. or greater, aggregation power of a binder resin itself is good in a high temperature region, which disturbs occurrence of hot offset phenomenon during fixing, while when it is not greater than 80° C., the lowest fixing temperature does not increase owing to sufficient melting. Glass transition points within the above-described range are therefore preferred.

The term "glass transition point" of a non-crystalline resin is a value as measured by a method (DSC) specified by ASTM D3418-82.

In the invention, the glass transition point can be measured, for example, by "DSC-20" (trade name; product of Seiko Instruments, Inc.) in accordance with differential scanning calorimetry (DSC). Described specifically, about 10 mg of a sample is heated at a predetermined temperature raising rate (10° C./min) and its glass transition point can be determined from an intersection between a baseline and an inclined line of an endothermic peak.

In the present invention, the block copolymer has preferably a glass transition point of from 50 to 80° C., more preferably from 50 to 65° C. Glass transition points of the block copolymer within the above-described range are preferred because the resulting toner does not easily cause caking and has good storage stability.

The block copolymer preferably has a melting point of from 50 to 100° C., more preferably from 50 to 80° C. The melting points of the block copolymer within the above-described range are preferred because the fixing property to thick paper, charging properties and resistance to filming on a photoreceptor can be attained simultaneously.

It is to be noted that some block copolymers do not exhibit clear melting point and glass transition point.

When a block copolymer is prepared by subjecting a mixture of the crystalline polyester resin and non-crystalline polyester resin to a polymerization reaction, the crystalline polyester resin to be mixed has preferably a weight average molecular weight of from 1,000 to 100,000, more preferably from 1,500 to 10,000. The non-crystalline polyester resin to be mixed has preferably a weight average molecular weight of from 1,000 to 100,000, more preferably from 2,000 to 10,000.

In the invention, the block copolymer has preferably a weight average molecular weight of from 5,000 to 500,000, more preferably from 5,000 to 50,000.

The block copolymer usable in the invention may be partially branched or crosslinked by selecting the number of carboxylic acids or alcohols of the monomer or by adding a crosslinking agent.

The weight average molecular weight Mw and number average molecular weight Mn can be determined by various known methods. A slight difference exists, depending on the measuring method, but it is preferred to employ the below-described measuring method in the invention. Described specifically, the weight average molecular weight Mw and number average molecular weight Mn are measured by gel permeation chromatography (GPC) under the below-described conditions. Measurement is conducted by causing a solvent (tetrahydrofuran) to flow at a flow rate of 1.2 ml per minute at 40° C. and pouring a tetrahydrofuran sample solution having a concentration of 0.2 g/20 ml in an amount of 3 mg in terms of a sample weight. When the molecular weight of the sample is measured, measurement conditions under which the molecular weight of the sample falls within a range in which the logarithm of the molecular weight of a calibration curve plotted based on several monodisperse polystyrene standard samples and count value become a straight line.

The reliability of the measurement results can be confirmed from the fact that NBS706 polystyrene standard samples employed in the above-described measurement has:

weight average molecular weight $Mw=28.8\times10^4$ number average molecular weight $Mn=13.7\times10^4$.

As a column of GPC, any column can be employed insofar as it can satisfy the above-described conditions. More specifically, "TSK-GEL, GMH" (trade name; product of TOSOH) can be employed.

The solvent and measuring temperature are not limited to the above-described ones, but can be changed properly.

The crystalline and non-crystalline polyester resins can be prepared by the polycondensation reaction between the above-described polyol and polycarboxylic acid in a conventional manner. This polycondensation reaction can be effected by conventional polycondensation method such as bulk polymerization, emulsion polymerization, polymerization in water such as suspension polymerization, solution polymerization, and interfacial polymerization. Of these, bulk polymerization is preferred. Although the reaction can be effected under atmospheric pressure, the reaction can be conducted as usual under reduced pressure in a nitrogen gas stream in order to increase the molecular weight of the polyester molecule.

Described specifically, a desired reaction product is available by charging the above-described polyol and polycarboxylic acid, and a catalyst if necessary in a reaction vessel equipped with a thermometer, a stirrer and a dropping condenser, heating the reaction mixture in the presence of an inert gas (such as nitrogen gas), continuously removing the by-produced low-molecule compound from the reaction system, terminating the reaction when the acid value reaches a predetermined value, and then cooling.

It is preferred that at least one of the crystalline polyester resin and non-crystalline polyester resin is polymerized at 150° C. or less in the presence of a sulfur-containing Bronsted acid catalyst, of which both of the crystalline polyester resin and non-crystalline polyester resin are polymerized at 150° C. or less in the presence of a sulfur-containing Bronsted acid catalyst.

It is more preferred that the block copolymer is formed by adding, to the crystalline polyester resin and non-crystalline polyester resin, a sulfur-containing Bronsted catalyst as a catalyst and heating the resulting mixture at 150° C. or less.

The reaction temperature is preferably 70° C. or greater but not greater than 150° C., more preferably 80° C. or greater but not greater than 140° C.

Reaction temperature of 70° C. or greater is preferred because deterioration in reactivity due to decrease in solubility of the monomer or weakening of catalytic activity does not occur and increase in the molecular weight is not disturbed. Reaction temperature not greater than 150° C. is also preferred because it enables preparation at low energy and moreover, it causes neither coloring of the resin or decomposition of the resulting polyester.

<Catalyst>

[Sulfur-containing Bronsted Catalyst]

Examples of the sulfur-containing Bronsted catalyst include, but not limited to, alkylbenzenesulfonic acids such as dodecylbenzehesulfonic acid, isopropylbenzenesulfonic acid and camphor-sulfonic acid, alkylsulfonic acids, alkyldisulfonic acids, alkylphenolsulfonic acids, alkylnaphthalenesulfonic acids, alkyltetralinsulfonic acids, alkylallylsulfonic acids, petroleum sulfonic acid, alkylbenzimidazolesulfonic acid, higher alcohol ether sulfonic acids, alkyldiphenylsulfonic acids, sulfate esters of a higher fatty acid such as monobutylphenylphenolsulfuric acid, dibutylphenylphenolsulfuric acid and dodecylsulfuric acid, higher alcohol sulfate esters, higher alcohol ether sulfate esters, higher fatty acid amidoalkylol sulfate esters, higher fatty acid amidoalkylated sulfate esters, naphthenylalcoholsulfuric acid, sulfated fat, sulfosuccinate esters, sulfonated higher fatty acids, and resin acid alcoholsulfuric acid and salt compounds thereof. These catalysts may have, in the structure thereof, a functional group. These catalysts may be used in combination if desired. Of these sulfur-containing Bronsted acid catalysts, alkylbenzenesulfonic acids can be used preferably, of which dodecylbenzenesulfonic acid, benzenesulfonic acid, p-toluenesulfonic acid and camphor sulfonic acid are especially preferred.

Another ordinarily employed polycondensation catalyst can also be used in combination with the above-described catalyst. Specific examples include metal catalysts, hydrolase type catalysts, basic catalysts and sulfur-free Bronsted catalysts.

[Metal Catalyst]

Examples of the metal catalyst include, but not limited to, organic tin compounds, organic titanium compounds, organic tin halide compounds and rare earth metals.

As the rare earth containing catalyst, those containing scandium (Sc), yttrium (Y) or a lanthanoid element such as lanthanum (La), cerium (Ce), praseodymium (Pr), neodymium (Nd), samarium (Sm), europium (Eu), gadolinium (Gd), terbium (Tb), dysprosium (Dy), holmium (Ho), erbium (Er), thulium (Tm), ytterbium (Yb) or ruthenium (Lu) are effective. These catalysts are especially effective when they have an alkylbenzenesulfonate, alkylsulfate ester salt or triflate structure. Examples of the triflate include those represented by the structural formula: $X(OSO_2CF_3)_3$ wherein X represents a rare earth element, preferably scandium (Sc), yttrium (Y), ytterbium (Yb) or samarium (Sm).

A detailed description of lanthanoid triflate is found in "Journal of Synthetic Organic Chemistry, Japan, 53 (5), p44-54".

When the metal catalyst is used as a catalyst, the metal content derived from the catalyst in the resulting resin is adjusted to 100 ppm or less, preferably 75 ppm or less, more preferably 50 ppm or less. This means that it is preferred not to use a metal catalyst or, if any, to use a metal catalyst in a very small amount.

[Hydrolase Type Catalyst]

No particular limitation is imposed on-the hydrolase type catalyst insofar as it catalyzes ester synthesis reaction. Examples of the hydrolase type catalyst to be used in the invention include esterases belonging to EC (enzyme number) 3.1 group (refer to "Enzyme Handbook", ed. by Maruo and Tamiya, published by Asakura Publishing Co. in 1982) such as carboxyesterase, lipase, phospholipase, acetylesterase, pectinesterase, cholesterol esterase, tannase, monoacylglycerol lipase, lactonase, and lipoprotein lipase; hydrolases such as glucosidase, galactosidase, glucuronidase and xylosidase belonging to EC 3.2 group which acts on glycosyl compounds; hydrolases such as epoxide hydrase belonging to EC 3.3 group; hydrolases such as aminopeptidase, chymotrypsin, trypsin, plasmin and subtilisin belonging to EC 3.4 group which act s on peptide bond, and hydrolases such as phloretin hydrolase belonging to EC 3.7 group.

Among the above-described esterases, enzymes which hydrolyze a glycerol ester to liberate a fatty acid are called "lipase". Lipase has high stability in an organic solvent, catalyzes an ester synthesis reaction with good efficiency and is available at a low cost. It is therefore preferred to use lipase from the viewpoints of yield and cost.

Lipases of various origins are usable, but preferred ones include lipase available from *Pseudomonas, Alcaligenes, Achromobacter, Candida, Aspergillus, Rhizopus* and *Mucor* microorganisms; lipases available from seeds of plants, lipases available from the tissue of animals, pancreatin and steapsin. Of these, use of lipases derived from *Pseudomonas, Candida* and *Aspergillus* microorganisms is preferred.

[Basic Catalyst]

Examples of the basic catalyst include, but not limited to, ordinarily employed organic basic compounds, nitrogenous basic compounds and tetraalkyl- or tetraarylphosphonium hydroxides such as tetrabutylphosphonium hydroxide. The organic basic compounds include ammonium hydroxides such as tetramethylammonium hydroxide and tetraethylammonium hydroxide; the nitrogenous basic compounds include amines such as triethylamine and dibenzylmethylamine, pyridine, methylpyridine, methoxypyridine, quinoline and imidazole, hydroxides, hydrides or amides of an alkali metal such as sodium, potassium, lithium or cesium, hydroxides, hydrides or amides of an alkaline earth metal such as calcium, magnesium or barium, and salts between an alkali or alkaline earth metal and an acid such as carbonate, phosphate, borate or carboxylate and salts with a phenolic hydroxyl group.

Additional examples include, but not limited to, compounds with an alcoholic hydroxyl group and chelate compounds with acetyl acetone.

[Sulfur-free Bronsted Catalyst]

Examples of the sulfur-free Bronsted catalyst include, but not limited to, various fatty acids, higher alkyl phosphate esters, resin acid, naphthenic acid and niobic acid.

The total amount of the catalyst is preferably from 0.01 to 10 wt. % based on the polycondensation components, more preferably from 0.01 to 8 wt. %. The catalysts can be used either singly or in combination.

(Electrostatic Latent Image Developing Toner and Production Process Thereof)

Although an electrostatic latent image developing toner can be prepared by any process in the invention, the below-described process is preferably adopted. In the present invention, a production process of an electrostatic latent image developing toner (which may hereinafter be called "toner", simply) preferably comprises aggregating, in a dispersion containing resin particles containing a block copolymer having at least a crystalline polyester block and a non-crystalline polyester block (which resin particles will hereinafter be called "block copolymer resin particles" or "resin particles", simply) and release agent particles, the resin particles and release agent particles to yield aggregated particles (which step may be called "aggregation step"), and heating the aggregated particles to cause fusion and coalescence thereof (which step may be called "fusion and coalescence step").

In the production process of an electrostatic latent image developing toner according to the invention, particles containing colorant particles (when the colorant has already been added to the resin in the polycondensation step, they themselves are colorant particles) and another resin particles, or a dispersion thereof may be added as needed to a dispersion containing the block copolymer resin particles having at least a crystalline polyester block and a non-crystalline polyester block and the release agent particles. The production process of an electrostatic latent image developing toner of the present invention can adjust a toner particle size and particle size distribution by aggregating (associating) the block copolymer resin particles, release agent particles and other added particles in the dispersion through a known aggregation method. Described specifically, the toner can be obtained by mixing the resin particle dispersion and the release agent particle dispersion with the colorant particle dispersion, adding an aggregating agent to the resulting mixture to cause hetero-aggregation, thereby preparing aggregated particles having a toner particle size, heating them at a glass transition point or melting point of the resin particles or greater to cause fusion and coalescence of the aggregated particles and then washing and drying. The toner shape can be changed from amorphous to spherical by selecting the heating temperature.

A dispersion of the block copolymer resin particles is prepared by dispersing the block copolymer in a water based medium. Any method can be employed for dispersion. For example, mechanical shearing or use of ultrasonic wave enables emulsification or dispersion.

The resin particle dispersion may contain additives such as surfactant, polymer dispersant and inorganic dispersant. During the above-described emulsification and dispersion, a surfactant, polymer dispersant and/or inorganic dispersant may be added to a water based medium as needed.

Examples of the water based medium usable in the invention include water such as distilled water and ion exchange water, and alcohols such as ethanol and methanol. Of these, ethanol and water are preferred, with water such as distilled water and ion exchange water being especially preferred. These water based media may be used either singly or in combination.

The water based media may include water miscible organic solvents. Examples of the water miscible organic solvent include acetone and acetic acid.

Examples of the surfactant usable in the invention include anionic surfactants such as sulfate ester salt, sulfonate salt and phosphate ester surfactants, cationic surfactants such as amine salt and quaternary ammonium salt surfactants, and nonionic surfactants such as polyethylene glycol, alkylphenol ethylene oxide adduct, and polyol surfactants. Of these, anionic surfactants and cationic surfactants are preferred.

These surfactants may be used either singly or in combination. The nonionic surfactants are preferably used in combination with the anionic surfactant or cationic surfactant.

Examples of the anionic surfactant include sodium dodecylbenzenesulfonate, sodium alkylnaphthalenesulfonate, sodium arylalkylpolyethersulfonate, sodium 3,3'-disulfonediphenylurea-4,4'-diazo-bis-amino-8-naphthol-6sulfonate, ortho-carboxybenzen-azo-dimethylaniline, sodium 2,2',5,5'-tetramethyl-triphenylmethane-4,4'-diazo-bis-β-naphthol-6-sulfonate, sodium dialkylsulfosuccinate, sodium dodecylsulfate, sodium tetradecylsulfate, sodium pentadecylsulfate, sodium octylsulfate, sodium oleate, sodium laurate, sodium caprate, sodium caprylate, sodium caproate, potassium stearate and calcium oleate.

Examples of the cationic surfactant include alkylbenzenedimethylammonium chloride, alkyltrimethylammonium chloride, and distearylammonium chloride.

Examples of the nonionic surfactant include polyethylene oxide, polypropylene oxide, combination of polypropylene oxide and polyethylene oxide, esters of polyethylene glycol and a higher fatty acid, alkylphenol polyethylene oxides, esters of a higher fatty acid and polyethylene glycol, esters of a higher fatty acid and polypropylene oxide, and sorbitan esters.

Examples of the polymer dispersant include sodium polycarboxylate and polyvinyl alcohol, while those of the inorganic dispersant include calcium carbonate. They do not limit the present invention at all.

In order to prevent the Ostwald Ripening phenomenon of monomer emulsion particles in a water based medium, a higher alcohol typified by heptanol or octanol, or a higher aliphatic hydrocarbon typified by hexadecane may be added as a stabilizing assistant.

In the above-described aggregation step of the invention, a dispersion of resin particles other than the dispersion of block copolymer resin particles is mixed with the dispersion of block copolymer resin particles, followed by the steps on and after the aggregation step. In this case, it is also possible to form multilayered particles by aggregating the dispersion of block copolymer resin particles to form first aggregated particles in advance, and adding the dispersion of block copolymer resin particles or another resin particle dispersion to form a second shell layer on the surface of the first particles. It is also possible to form multilayered particles by reversing the order of the above-described example.

It is also possible to aggregate a resin particle dispersion containing a block copolymer and a colorant particle dispersion in advance to form first aggregated particles, and adding the resin particle dispersion containing a block copolymer or another resin particle dispersion to form a second shell layer on the surface of the first particles. In the above-described example, a colorant particle dispersion is prepared separately, but it is needless to say that a colorant may be incorporated in the block copolymer of the invention in advance.

As the aggregating agent, inorganic salts and metal salts having two or more valences are suited as well as the surfactants. Especially, metal salts are preferred from the standpoints of properties such as control of aggregation and toner charging properties. The metal salt compound to be used for aggregation is obtained by dissolving an ordinary inorganic metal compound or polymer thereof in the resin particle dispersion. The metal element constituting an inorganic metal salt is usable insofar as it has two or more charges, belongs to Groups 2A, 3A, 4A, 5A, 6A, 7A, 8, 1B, 2B or 3B in the periodic table (long periodic table) and is soluble in the ion form in the aggregation system of resin particles. Specific preferred examples of the inorganic metal salt include metal salts such as calcium chloride, calcium nitrate, barium chloride, magnesium chloride, zinc chloride, aluminum chloride and aluminum sulfate, and polymers of an inorganic metal salt such as polyaluminum chloride, polyaluminum hydroxide and calcium polysulfide. Of these, aluminum salts and polymers thereof are especially preferred. Inorganic metal salts having higher valences are preferred in order to obtain sharper particle size distribution. When the valences are equal, a polymer of an inorganic metal salt are more suited than the inorganic metal salt.

In the invention, in addition to the dispersion of block copolymer resin particles, a dispersion of addition polymerization resin particles prepared by conventionally known emulsion polymerization or the like can also be used in combination. The resin particles in the dispersion of addition polymerization resin particles which can be used in the invention have preferably a median size of 0.02 μm or greater but not greater than 2.0 μm similar to the resin particle dispersion of the invention.

Examples of the addition polymerization monomer to be useable for the preparation of such a dispersion of addition polymerization resin particles include styrenes such as styrene and parachlorostyrene, vinyl esters such as vinyl naphthalene, vinyl chloride, vinyl bromide, vinyl fluoride, vinyl acetate, vinyl propionate, vinyl benzoate, and vinyl acetate, methylene aliphatic carboxylate esters such as methyl acrylate, ethyl acrylate, n-butyl acrylate, isobutyl acrylate, dodecyl acrylate, n-octyl-acrylate, 2-chloroethyl acrylate, phenyl acrylate, methyl α-chloroacrylate, methyl methacrylate, ethyl methacrylate and butyl methacrylate, acrylonitrile, methacrylonitrile, acrylamide, vinyl ethers such as vinyl methyl ether, vinyl ethyl ether, and vinyl isobutyl ether, monomers having an N-polar group, for example, N-vinyl compounds such as N-vinylpyrrole, N-vinylcarbazole, N-vinylindole and N-vinylpyrrolidone, and vinylcarboxylic acids such as methacrylic acid, acrylic acid, cinnamic acid and carboxyethyl acrylate. Homopolymers or copolymers of vinyl monomers and various waxes can also be used in combination.

In the case of the addition polymerization monomer, a resin particle dispersion can be prepared by emulsion polymerization of it by using an ionic surfactant. In the case of another resin which is oily and soluble in a solvent having a relatively low water solubility, a resin particle dispersion of it can be obtained by dissolving the resin in such a solvent, dispersing, in the particulate form, the resulting solution together with an ionic surfactant and a polymer electrolyte in a water based medium by using a dispersing machine such as homogenizer, and then heating or reducing the pressure to cause evaporation of the solvent.

During the polymerization of an addition polymerization monomer, a polymerization initiator or chain transfer agent can be employed. Specific examples include ammonium persulfate, potassium persulfate, sodium persulfate, 2,2'-azobis (2-methylpropionamide)dihydrochloride, t-butylperoxy-2-ethylhexanoate, cumyl perpivalate, t-butyl peroxylaurate, benzoyl peroxide, lauroyl peroxide, octanoyl peroxide, di-t-butyl peroxide, t-butylcumyl peroxide, dicumyl peroxide, 2,240 -azobisisobutyronitrile, 2,2'-azobis (2-methylbutyronitrile), 2,2'-azobis (2,4-dimethylvaleronitrile), 2,2'-azobis (4-methoxy-2,4-dimethylvaleronitrile), 1,1-bis (t-butylperoxy)-3,3,5-trimethylcyclohexane, 1,1-bis(t-butylperoxy)cyclohexane, 1,4-bis(t-butylperoxycarbonyl)cyclohexane, 2,2-bis(t-butylperoxy)octane, n-butyl-4,4-bis(t-butylperoxy) valerate, 2,2-bis(t-butylperoxy)butane, 1,3-bis(t-butylperoxyisopropyl)benzene, 2,5-dimethyl-2,5-di(t-butylperoxy)hexane, 2,5-dimethyl-2,5-di(benzoylperoxy) hexane, di-t-butyl diperoxyisophthalate, 2,2-bis(4,4-di-t-butylperoxycyclohexyl)propane, di-t-butyl peroxy-α-methylsuccinate, di-t-butyl peroxydimethylglutarate, di-t-butyl peroxyhexahydroterephthalate, di-t-butyl peroxyazelate, 2,5-dimethyl-2,5-di(t-butylperoxy)hexane, diethyleneglycol-bis(t-butyl peroxycarbonate), di-t-butyl peroxytrimethyladipate, tris(t-butylperoxy)triazine, vinyl tris (t-butylperoxy)silane, 2,2'-azobis (2-methylpropionamidine dihydrochloride), 2,2'-azobis[N-(2-carboxyethyl)-2-methylpropionamidine] and 4,4'-azobis(4-cyanovaleric acid).

No particular limitation is imposed on the chain transfer agent. Those having a covalent bond between a carbon atom and a sulfur atom are preferred. Preferred examples include thiols.

In the invention, known additives can be incorporated either singly or in combination as needed within a range not adversely affecting the results of the invention. Examples include flame retardants, flame retarding assistants, gloss agents, water proofing agents, water repellents, magnetic materials, inorganic fillers (surface modifiers), release agents, antioxidants, plasticizers, surfactants, dispersants, lubricants, fillers, extender pigments, binders and charge controllers. These additives can be incorporated in any step of preparing a coating agent.

In the present invention, it is also possible, prior to polycondensation of polycondensable resin particles in a water based medium, to mix components necessary for the preparation of a toner such as a colorant, a fixing assistant such as wax and a charging assistant in the water based medium and then incorporate the resulting mixture in the polycondensable resin particles upon polycondensation.

The colorants usable in the invention will be exemplified below.

Examples of a black pigment include carbon black, copper oxide, manganese dioxide, aniline black, activated carbon, non-magnetic ferrite and magnetite.

Examples of a yellow pigment include chrome yellow, zinc yellow, yellow iron oxide, cadmium yellow, Hansa Yellow, Hansa Yellow 10G, Benzidine Yellow G, Benzidine Yellow GR, Suren Yellow, Quinoline Yellow and Permanent Yellow NCG.

Examples of an orange pigment include red chrome yellow, molybdenum orange, Permanent Orange GTR, Pyrazolone Orange, Vulcan Orange, Benzidine Orange G, Indanthrene Brilliant Orange RK and Indanthrene Brilliant Orange GK.

Examples of a red pigment include red iron oxide, cadmium red, red lead oxide, mercury sulfide, Watchung Red, Permanent Red 4R, Lithol Red, Brilliant Carmine 3B, Brilliant Carmine 6B, DuPont Oil Red, Pyrazolone Red, Rhodamine B Lake, Lake Red C, Rose Bengal, Eosine Red and Alizarin Lake.

Examples of a blue pigment include Prussian Blue, cobalt blue, Alkali Blue Lake, Victoria Blue Lake, Fast Sky Blue, Indanthrene Blue BC, Aniline Blue, Ultramarine Blue, Calco Oil Blue, Methylene Blue Chloride, Phthalocyanine Blue, Phthalocyanine Green and Malachite Green Oxalate.

Examples of a violet pigment include manganese violet, Fast Violet B and Methyl Violet Lake.

Examples of a green pigment include chromium oxide, chromium green, Pigment Green, Malachite Green Lake and Final Yellow Green G.

Examples of a white pigment include zinc white, titanium oxide, antimony white and zinc sulfide.

Examples of an extender pigment include barite powder, barium carbonate, clay, silica, white carbon, talc and white alumina.

Examples of a dye include various kinds of dyes such as basic, acidic, dispersion and direct dyes, for example, nigrosine, Methylene Blue, Rose Bengal, Quinoline Yellow and Ultramarine Blue.

These colorants are used either singly or as a mixture. A dispersion of colorant particles can be prepared using an ordinarily employed dispersing method, for example, using a rotation shearing homogenizer, a media-type dispersing machine which carries out dispersion with the aid of a medium such as ball mill, sand mill, attritor or "DYNO-MILL" (trade name), or a high pressure counter collision dispersing machine.

The colorant can also be dispersed in a water based medium in a homogenizer by using a surfactant having polarity. It may be added together with another fine particle component in a mixed solvent or may be added in portions.

The colorant used in the invention is selected from the standpoint of hue angle, chroma saturation, brightness, weather resistance, OHP transparency and dispersibility in the toner.

The colorant can be added in an amount of from 4 to 15 wt. % based on the weight of the total solid content of the toner.

When a magnetic material is used as a black colorant, it can be added in an amount of from 12 to 240 wt. %, which is different from the amount of the other colorants.

The colorant is added in an amount necessary for assuring color development property upon fixing. By adjusting the central diameter (median size) of the colorant particles in the toner to from 100 to 330 nm, the OHP transparency and the color development property can be assured.

The central diameter of the colorant particles was measured, for example, by a laser diffraction particle size measuring apparatus ("LA-920", trade name; product of Horiba, Ltd.).

Specific examples of the release agent usable in the invention include various ester waxes, low molecular weight polyolefins such as polyethylene, polypropylene and polybutene, silicones exhibiting a softening point by heating, fatty acid amides such as oleic acid amide, erucic acid amide, ricinoleic acid amide and stearic acid amide, vegetable waxes such as carnauba wax, rice wax, candelilla wax, wood wax and jojoba oil, animal waxes such as beeswax, mineral or petroleum waxes such as montan wax, ozokerite, ceresin, paraffin wax, microcrystalline wax and Fischer-Tropsch wax, and modified products thereof.

These waxes are sparingly soluble in a solvent such as toluene at around room temperature or even if they are soluble, the dissolved amount is quite small.

A dispersion of each of these waxes can be prepared by dispersing the wax together with an ionic surfactant and a polymer electrolyte such as polymer acid and polymer base in water, heating the resulting dispersion to a temperature of the melting point thereof or greater and at the same time, dispersing further in the particulate form in a homogenizer or a pressure discharge dispersing machine (Gaulin Homogenizer, product of Gaulin) having a strong shear capacity to form a dispersion of particles having a particle size of 1 μm or less.

Such a release agent is preferably added in an amount of from 5 to 25 wt. % based on the total weight of the solid content of the toner in order to assure releasing property of a fixed image in an oilless fixing system.

The particle size of the release agent particle dispersion thus obtained was measured, for example, by a laser diffraction particle size measuring apparatus ("LA-920", trade name; product of Horiba, Ltd.). When the release agent is used, it is preferred to add, after aggregation of resin particles, colorant particles and release agent particles, a resin particle dispersion, thereby attaching resin particles to the surface of the aggregated particles from the standpoints of assuring charging properties and durability.

As the magnetic material, substances which are magnetized in a magnetic field are used and specific examples of it include ferromagnetic powder such as iron, cobalt and nickel and compounds such as ferrite and magnetite.

When a toner is obtained in a water based medium in the invention, a care must be paid to the transferring property of a magnetic material to an aqueous phase. It is preferred to modify the surface of a magnetic material in advance, for example, by making the surface hydrophobic.

As the charge controller, various ordinarily employed charge controllers such as quaternary ammonium salt compounds, nigrosine compounds, dyes composed of a complex with aluminum, iron or chromium, and triphenylmethane pigments can be used. Materials not easily insoluble in water are suited from the viewpoint of control of ionic strength affecting on the stability during aggregation or coalescence and a reduction in the contamination of waste water.

It is effective to use, in combination, a surfactant for polycondensation, pigment dispersion, preparation or dispersion of resin particles, dispersion of a release agent, aggregation or stabilization of the aggregated particles. Examples include anionic surfactants such as sulfate ester salt, sulfonate salt, phosphate ester and soap surfactants, cationic surfactants such as amine salt and quaternary ammonium salt surfactants and nonionic surfactants such as polyethylene glycol, alkylphenol ethylene oxide adduct and polyhydric alcohol surfactants. For dispersion, ordinarily employed means such as rotation shearing homogenizer and media-type dispersing machines such as ball mill, sand mill and "DYNO-MILL" (trade name) can be used.

Examples of the flame retardant or flame-retarding assistant include, but not limited to, brominated flame retardants, antimony trioxide, magnesium hydroxide, aluminum hydroxide and ammonium polyphosphate which have already been used generally.

Desired toner particles can be obtained through optional washing step, solid-liquid separation step and drying step after completion of the fusion and coalescence step of aggregated particles. In the washing step, sufficient displacement washing with ion exchange water is desired when charging properties are taken into consideration. Although no particular limitation is imposed on the solid-liquid separation step, suction filtration or pressure filtration is suited from the viewpoint of productivity. Although no particular limitation is imposed also on the drying step, lyophilization, flash jet drying, fluidized drying or vibrating fluidized drying is preferred from the viewpoint of the productivity.

The toner of the invention is preferably used after mixing with inorganic particles or after addition thereof to the surface of resin particles in order to impart it with fluidity or improve its cleaning property.

Inorganic particles usable in the invention have a primary particle diameter of from 5 nm to 2 μm, preferably from 5 nm to 500 nm. They have a BET specific surface area of from 20 to 500 $m^2/g$. The inorganic particles are mixed in the toner in an amount of from 0.01 to 5 wt. %, preferably from 0.01 to 2.0 wt. %.

Examples of such inorganic particles include silica powder, alumina, titanium oxide, barium titanate, magnesium titanate, calcium titanate, strontium titanate, zinc oxide, silica sand, clay, mica, wollastonite, diatomaceous earth, chromium oxide, cerium oxide, red oxide, antimony trioxide, magnesium oxide, zirconium oxide, barium sulfate, barium carbonate, calcium carbonate, silicon carbide, and silicon nitride. Of these, silica powder is especially preferred.

The term "silica powder" as used herein means a powder having an Si—O—Si bond and includes those manufactured by the dry method and wet method. Any of anhydrous silicon dioxide, aluminum silicate, sodium silicate, potassium silicate, magnesium silicate and zinc silicate can be used. Anyway, silica powder containing at least 85 wt. % of $SiO_2$ is preferred.

Silica powder is commercially available as various products, but that having a hydrophobic group on its surface is preferred. Examples include "AEROSIL R-972", "R-974", "R-805" and "R-812" (each, trade name; product of Aerosil), and "Talax 500" (trade name; product of Talco). In addition, silica powder treated with a silane coupling agent, a titanium coupling agent, a silicone oil or silicone oil having, on the side chain thereof, an amine can be used.

The cumulative volume average particle size $D_{50}$ of the toner of the invention is suitably within a range of from 3.0 to 9.0 μm, preferably from 3.0 to 5.0 μm. When the $D_{50}$ is 3.0 μm or greater, the toner has an adequate adhesion strength and excellent developing property. When the $D_{50}$ is 9.0 μm or less, the resolving property of the image is good. The volume average particle sizes within the above-described range are therefore preferred.

Also, the volume average particle size distribution index GSDv of the toner of the invention is preferably 1.30 or less. When GSDv is 1.30 or less, the toner has good resolving property and it does not easily cause image defects such as scattering of the toner and fog. The GSDv within the above-described range is therefore preferred.

The cumulative volume average particle size $D_{50}$ or average particle size distribution index of the toner of the invention is determined as follows. Based on the particle size distribution measured using a measuring apparatus such as "Coulter Counter TA II" (trade name; product of Beckman Coulter) or "Multisizer II" (trade name; product of Beckman Coulter), cumulative distributions of the volume and the number of the respective toner particles are drawn from the small diameter side for divided particle size ranges (channels). The particle sizes providing an accumulation of 16% are designated as a volume average particle size $D_{16v}$ and a number average particle size $D_{16p}$, the particle sizes providing an accumulation of 50% are designated as a volume average particle size $D_{50v}$,and a number average particle size $D_{50p}$, and the particle sizes providing an accumulation of 84% are designated as a volume average particle size $D_{84v}$ and a number average particle size $D_{84p}$. By using them, the volume average particle size distribution index GSDv is calculated from $(D_{84v}/D_{16v})^{1/2}$, and the number average particle size distribution index GSDp is calculated from $(D_{84p}/D_{16p})^{1/2}$.

The shape factor SF1 of the toner of the invention is preferably from 100 to 140, more preferably from 110 to 135, from the standpoint of image forming property. The shape factor SF1 in the invention can be obtained in numerical terms by analyzing a microscopic image or a scanning electron microscopic image by an image analyzer. It can be obtained, for example, in the following manner. An optical microscopic image of the toner scattered on slide glass is imported into a Luzex image analyzer through a video camera, and 50 or more toner particles are measured for the absolute maximum length and the projected area. The shape factor SF1 of the toner is determined in accordance with the following equation.

$$SF1 = \frac{(ML)^2}{A} \times \frac{\pi}{4} \times 100$$

wherein, ML is an absolute maximum length of toner particles and A is a projected area of toner particles.

(Electrostatic Latent Image Developer)

In the invention, the electrostatic latent image developing toner can be used as an electrostatic latent image developer. There is no particular limitation imposed on this developer insofar as it contains the electrostatic latent image developing toner. Its composition can be varied as needed, depending on the using purpose. When the electrostatic latent image developing toner is used alone, an electrostatic latent image developer is prepared as one component type, while the toner is used in combination with a carrier, an electrostatic latent image developer is prepared as a two component type.

To the one component type developer, it is also possible to apply a method of forming a charged toner by frictional electrification with a developing sleeve or charging member and developing it according to an electrostatic latent image.

No particular limitation is imposed on the carrier. Examples include magnetic particles of iron powder, ferrite, iron oxide and nickel; resin coated carriers obtained by coating the surfaces of magnetic particles as a core with a resin such as a styrene resin, vinyl resin, ethylene resin, rosin resin, polyester resin or melamine resin or wax such as stearic acid to form a resin coated layer; and carriers obtained by dispersing magnetic fine particles in a binder resin. Of these, the resin coated carriers are especially preferred because the chargeability of the toner or the resistance of the overall carrier can be controlled by the constitution of the resin coated layer.

With regards to the mixing ratio of the toner of the invention and carrier in the two component type electrostatic latent image developer, 2 to 10 parts by weight of the toner is usually added to 100 parts by weight of the carrier. Although no particular limitation is imposed on the preparation process of a developer, mixing, for example, in a V blender or the like can be employed.

(Image Forming Method)

An image forming method of the invention comprises forming an electrostatic latent image on the surface of a latent image supporting member, developing the electrostatic latent image formed on the surface of the latent image supporting member with an electrostatic latent image developing toner or a developer containing the toner and a carrier to form a toner image; transferring the toner image formed on the surface of the latent image supporting member onto a surface of a transfer receiving material; and fixing the toner image transferred onto the transfer receiving material under pressure; wherein when the toner image is fixed under pressure, a maximum pressure is 1 MPa or greater but not greater than 10 MPa.

The maximum pressure applied when the toner image is fixed is more preferably from 1 to 10 MPa, still more preferably from 2 to 8 MPa.

In the invention, the electrostatic latent image developing toner contains a block copolymer having a crystalline polyester resin and a non-crystalline polyester resin. Such a resin exhibits a plastic behavior when pressure is applied. When the maximum pressure during fixing is less than 1 MPa, the toner image is not fixed to thick paper sufficiently. When the maximum pressure exceeds 10 MPa, a decrease in hot offset temperature tends to cause contamination of an image, contamination of a fixing roll and twining of paper. In addition, so-called "paper curling" meaning large bending of paper occurs after fixing.

Pressure distribution between a fixing roll and a pressure roll or the like can be measured by a commercially available pressure distribution measuring sensor, more specifically, "roller-roller pressure measuring system" (product of Kamata Industries). In the invention, the term "maximum pressure" during fixing means the maximum value in a pressure change at from the inlet to the outlet of a fixing nip in the paper traveling direction.

For each of the above-described steps, known steps in the image forming method as described, for example, in JP-A-56-40868 or JP-A-49-91231 can be employed. The image forming method of the invention may comprise another step in addition to the above-described steps. Preferred examples include a cleaning step of removing an electrostatic latent image developer remaining on an electrostatic latent image supporting member. The image forming method of the invention preferably comprises a recycling step further. The recycling step is a step of transferring an electrostatic latent image developing toner collected in the cleaning step to a developer layer. The image forming method including this recycling step can be carried out using an image forming apparatus such as a toner recycle system type copier or facsimile. This method can also be applied to a recycle system in which a cleaning step is omitted and a toner is collected simultaneously with development.

As the latent image supporting member, an electrophotographic photoreceptor and a dielectric recording medium may be used.

In the case of an electrophotographic photoreceptor, the surface of the electrophotographic photoreceptor is homogeneously charged by a corotron charger or a contact charger, and is then exposed to a light beam to form an electrostatic latent image (latent image forming step). The latent image thus formed is then brought into contact with or brought close to a developing roll having a developer layer formed on the surface thereof, and toner particles are attached to the electrostatic latent image, whereby a toner image is formed on the electrophotographic photoreceptor (developing step). The toner image thus formed is transferred by a corotron charger or the like onto the surface of a transfer receiving material such as a sheet of paper (transfer step). The toner image thus transferred to the surface of the transfer receiving material is thermally fixed by a fixing device (fixing step), whereby a final toner image is formed.

When the toner image is thermally fixed by the fixing device, a release agent is usually supplied to a fixing member in the fixing device in order to prevent offset or the like.

The image forming method of the invention is especially preferably employed when high-speed fixation is carried out, for example, when contact time between the toner on transfer paper and a heating roller is within 1 second, especially within 0.5 second.

EXAMPLES

The present invention will hereinafter be described in detail by Examples. It should however be borne in mind that the present invention is not limited by them.

<Measurement of Glass Transition Point and Melting Point>

They were measured using a differential scanning calorimeter (DSC), more specifically, "DSC50" (trade name; product of Shimadzu).

Sample: from 3 to 15 mg, preferably from 5 to 10 mg

Measuring method: A sample is put in an aluminum pan while an empty aluminum pan is used as a reference.

Temperature curve: Temperature raise I (20° C. to 180° C., temperature raising rate: 10° C./min)

Temperature lowering I (from 180° C. to 10° C., temperature lowering rate: 10° C./min)

Temperature raise II (from 10° C. to 180° C., temperature raising rate: 10° C./min)

The glass transition point is determined based on an endothermic curve as measured by "Temperature increase II" in the above-described temperature curve. The term "glass transition point" as used herein means the temperature at an intersection between a tangent line of the curve at the lowest temperature, among the temperatures permitting the derivative value of the endothermic curve peak to be the maximum, and a base line. The term "melting point" is determined by measuring the maximum value of a melting absorption peak in the "Temperature raise I".

The central diameter of particles in the dispersion was measured using "LA920" (trade name; product of Horiba, Ltd.). The $D_{50}$ and GSDv of the toner were measured using a measuring apparatus such as "Coulter Counter TA II" (trade name; product of Beckman Coulter) or "Multisizer II" (trade name; product of Beckman Coulter) K.K.).

In the toners of the below-described Examples, aggregated particles were obtained by preparing the below-described resin particle dispersion, colorant particle dispersion and release agent particle dispersion, respectively, mixing them at a predetermined ratio, adding a polymer of a metal salt while stirring, and ionically neutralizing the mixture. After adjusting the pH in the system from weakly acidic to neutral by the addition of an inorganic hydroxide, the particles were heated at a temperature of the glass transition point of the resin particles or greater to cause fusion and coalescence. After completion of the reaction, sufficient washing, solid-liquid separation and drying were carried out, whereby a desired toner was obtained. The preparation process of each of the dispersions will next be described.

(Preparation of a Resin Particle Dispersion)

<Preparation of Resin Particle Dispersion (1)>

| | |
|---|---|
| 1,4-Cyclohexanedicarboxylic acid | 175 parts by weight |
| Ethylene oxide (1 mole) adduct of bisphenol A | 310 parts by weight |
| Dodecylbenzenesulfonic acid | 0.5 parts by weight |

The above-described materials were mixed and charged in a reactor equipped with a stirrer. The mixture was polycondensed at 120° C. for 5 hours under a nitrogen atmosphere to yield a uniform and transparent non-crystalline polyester resin.

The resulting resin had a weight average molecular weight by GPC of 7,500 and had a glass transition point (onset) was 54° C.

| | |
|---|---|
| Caprolactone | 90 parts by weight |
| Dodecylbenzenesulfonic acid | 0.2 parts by weight |

The above-described materials were mixed and charged in a reactor equipped with a stirrer. The mixture was polycondensed at 90° C. for 5 hours under a nitrogen atmosphere to yield a uniform and transparent crystalline polyester oligomer.

The resulting resin had a weight average molecular weight by GPC of 4,000 and had a crystal melting point of 60° C.

After the two resins thus obtained were mixed at 100° C., the resulting mixture was heated for 5 hours in a reactor equipped with a stirrer, whereby a block copolymer was formed. The block copolymer had a glass transition point (onset), as measured by DSC, of 53° C. and its melting point was observed at near 60° C. as a small peak.

It had a weight average molecular weight, by GPC, of 12,000.

To 100 parts of the resulting resin was added 0.5 parts by weight of soft-type sodium dodecylbenzenesulfonate as a surfactant, followed by the addition of 300 parts by weight of ion exchange water. While heating to 80° C., the resulting mixture was mixed and dispersed thoroughly by a homogenizer ("Ultratalax T50", trade name; product of IKA) in a round-bottom flask made of glass.

After the pH in the system was adjusted to 5.0 with a 0.5 mole/liter aqueous solution of sodium hydroxide, the dispersion was heated to 90° C. without stopping stirring by a homogenizer to yield an emulsion dispersion of the block copolymer resin. In the resulting resin particle dispersion (1), the central diameter of the resin particles was 220 nm and the solid content was 20%.

<Preparation of Resin Particle Dispersion (2)>

| | |
|---|---|
| 1,4-Cyclohexanedicarboxylic acid | 175 parts by weight |
| Ethylene oxide (1 mole) adduct of bisphenol A | 310 parts by weight |
| Dodecylbenzenesulfonic acid | 0.5 parts by weight |

The above-described materials were mixed and charged in a reactor equipped with a stirrer. The mixture was polycondensed at 120° C. for 5 hours under a nitrogen atmosphere to yield a uniform and transparent non-crystalline polyester resin. The resulting resin had a weight average molecular weight by GPC of 7,500 and had a glass transition point (onset) was 54° C.

| | |
|---|---|
| Dodecylbenzenesulfonic acid | 0.36 parts by weight |
| 1,9-Nonanediol | 80 parts by weight |
| 1,10-Decamethylenedicarboxylic acid | 115 parts by weight |

The above-described materials were mixed and melted by heating at 120° C. The resulting melted mixture was then kept at 80° C. for 3 hours, whereby a crystalline resin having a weight average molecular weight by GPC of 5,500 and a crystal melting point of 62° C. was obtained.

After the two resins thus obtained were mixed at 100° C., the resulting mixture was heated for 5 hours in a reactor equipped with a stirrer, whereby a block copolymer was formed. The block copolymer had a glass transition point (onset), as measured by DSC, of 52° C. and its melting point was observed at near 60° C. It had a weight average molecular weight, by GPC, of 14,600.

To 100 parts of the resulting resin was added 0.5 parts by weight of soft-type sodium dodecylbenzenesulfonate as a surfactant, followed by the addition of 300 parts by weight of ion exchange water. While heating to 80° C., the resulting mixture was mixed and dispersed thoroughly by a homogenizer ("Ultratalax T50", trade name; product of IKA) in a round-bottom flask made of glass.

After the pH in the system was adjusted to 5.0 with a 0.5 mole/liter aqueous solution of sodium hydroxide, heating was conducted to 90° C. without stopping stirring by a homogenizer to yield an emulsion dispersion of block copolymer resin particles. In the resulting resin particle dispersion (2), the central diameter of the resin particles was 200 nm and the solid content was 20%.

<Preparation of Resin Particle Dispersion (3)>

| | |
|---|---|
| 1,4-Phenylenedipropanoic acid | 222 parts by weight |
| Propylene oxide (1 mole) adduct of bisphenol A | 344 parts by weight |
| P-Toluenesulfonic acid | 0.7 parts by weight |

The above-described materials were mixed and charged in a reactor equipped with a stirrer. The mixture was polycondensed at 120° C. for 5 hours under a nitrogen atmosphere to yield a uniform and transparent non-crystalline polyester resin. The resulting resin had a weight average molecular weight by GPC of 5,000 and had a glass transition point (onset) was 51° C.

| | |
|---|---|
| Dodecylbenzenesulfonic acid | 0.36 parts by weight |
| 1,9-Nonanediol | 80 parts by weight |
| 1,10-Decamethylenedicarboxylic acid | 115 parts by weight |

The above-described materials were mixed and melted by heating at 120° C. The resulting melted mixture was then kept at 80° C. for 3 hours, whereby a crystalline resin having a weight average molecular weight by GPC of 5,500 and had a crystal melting point of 62° C. was obtained.

After the two resins thus obtained were mixed at 100° C., the resulting mixture was heated for 5 hours in a reactor equipped with a stirrer, whereby a block copolymer was formed. The block copolymer had a glass transition point (onset), as measured by DSC, of 50° C. and its melting point was observed at near 60° C. It had a weight average molecular weight, by GPC, of 13,000.

To 100 parts of the resulting resin was added 0.5 parts by weight of soft-type sodium dodecylbenzenesulfonate as a surfactant, followed by the addition of 300 parts by weight of ion exchange water. While heating to 80° C., the resulting mixture was mixed and dispersed thoroughly by a homogenizer ("Ultratalax T50", trade name; product of IKA) in a round-bottom flask made of glass.

After the pH in the system was adjusted to 5.0 with a 0.5 mole/liter aqueous solution of sodium hydroxide, heating was conducted to 90° C. without stopping stirring by a homogenizer to yield an emulsion dispersion of block copolymer resin particles. In the resulting resin particle dispersion (3), the central diameter of the resin particles was 200 nm and the solid content was 20%.

The resin particle dispersions (1) to (3) thus obtained are shown in the following table.

TABLE 1

| | | Resin particle dispersion (1) | Resin particle dispersion (2) | Resin particle dispersion (3) |
|---|---|---|---|---|
| Non-crystalline polyester resin | Polycondensable monomer | 1,4-Cyclohexane-dicarboxylic acid Ethylene oxide (1 mole) adduct | 1,4-Cyclohexane-dicarboxylic acid Ethylene oxide (1 mole) adduct | 1,4-Phenylene-dipropanoic acid Propylene oxide (1 mole) adduct |

TABLE 1-continued

| | | Resin particle dispersion (1) | Resin particle dispersion (2) | Resin particle dispersion (3) |
|---|---|---|---|---|
| | | of bisphenol A | of bisphenol A | of bisphenol A |
| | Catalyst | Dodecylbenzene-sulfonic acid | Dodecylbenzene-sulfonic acid | p-Toluenesulfonic acid |
| | Mw | 7,500 | 7,500 | 5,000 |
| | Half-width (° C.) of endothermic peak | Not observed because of stepwise transfer | Same as on the left | Same as on the left |
| | Tg (° C.) | 54 | 54 | 51 |
| Crystalline polyester resin | Polycondensable monomer | Caprolactone | 1,9-Nonanediol 1,10-Decamethylene-dicarboxylic acid | 1,9-Nonanediol 1,10-Decamethylene-dicarboxylic acid |

| | Catalyst | Dodecylbenzene-sulfonic cid | Dodecylbenzene-sulfonic acid | Dodecylbenzene-sulfonic acid |
|---|---|---|---|---|
| | Mw | 4,000 | 5,500 | 5,500 |
| | Half-width (° C.) of endothermic peak | 12 | 6 | 6 |
| | Melting point (° C.) | 60 | 62 | 62 |
| Block copolymer | Mw | 12,000 | 14,600 | 13,000 |
| | Tg (° C.) | 53 | 52 | 50 |
| | Melting point (° C.) | Observed at near 60° C. as a small peak | 60 | 60 |
| Resin fine particles | Central diameter (nm) | 220 | 200 | 200 |
| | Solid content (%) | 20 | 20 | 20 |

<Preparation of Resin Particle Dispersion (4)>

In a similar manner to that employed for the preparation of the resin particle dispersion (1) except that only 1,4-cyclohexanedicarboxylic acid, ethylene oxide (1 mole) adduct of bisphenol A and dodecylbenzenesulfonic acid were added while omitting the crystalline resin, and the polymerization time was extended by 3 hours, a non-crystalline polyester resin (Tg: 54° C.) having Mw of 12,000 was obtained. To 100 parts of the resulting resin was added 0.5 parts by weight of soft-type sodium dodecylbenzenesulfonate as a surfactant, followed by the addition of 300 parts by weight of ion exchange water. While heating to 80° C., the resulting mixture was mixed and dispersed thoroughly by a homogenizer ("Ultratalax T50", trade name; product of IKA) in a round-bottom flask made of glass.

After the pH in the system was adjusted to 5.0 with a 0.5 mole/liter aqueous solution of sodium hydroxide, the dispersion was heated to 90° C. without stopping stirring by a homogenizer to yield an emulsion dispersion of a crystalline resin. In the resulting resin particle dispersion (4), the central diameter of the resin particles was 210 nm and the solid content was 20%.

(Preparation of Colorant Particle Dispersion)

<Preparation of Colorant Particle Dispersion (P1)>

Cyan Pigment (product of Dainichi Color & Chemicals,

| | |
|---|---|
| Copper Phthalocyanine, C.I. Pigment Blue 15:3) | 50 parts by weight |
| Anionic Surfactant ("Neogen R", trade name; product of Daiichi Kogyo Seiyaku) | 5 parts by weight |
| Ion exchange water | 200 parts by weight |

After the above-described components were mixed and dissolved, the resulting solution was dispersed for 5 minutes by a homogenizer ("Ultratalax", trade name; product of IKA) and for 10 minutes by a ultrasonic bath to give a cyan colorant particle dispersion (P1) having a central diameter of 190 nm and solid content of 21.5%.

<Preparation of Colorant Particle Dispersion (P2)>

In a similar manner to that employed for the preparation of the colorant particle dispersion (P1) except that the cyan pigment was replaced by a magenta pigment ("PR122", trade name; product of Dainippon Ink and Chemicals), a magenta colorant particle dispersion (P2) having a central diameter of 165 nm and a solid content of 21.5% was prepared.

(Preparation of Release Agent Particle Dispersion)

<Preparation of Release Agent Particle Dispersion (W1)>

| | |
|---|---|
| Dodecylsulfuric acid | 30 parts by weight |
| Ion exchange water | 852 parts by weight |

The above-described components were mixed to prepare an aqueous solution of dodecylsulfuric acid.

| | |
|---|---|
| Palmitic acid | 188 parts by weight |
| Pentaerythritol | 25 parts by weight |

The above-described components were mixed and the resulting mixture was melted by heating to 250° C. The molten mixture was then poured into the above-described aqueous solution of dodecylsulfuric acid. After emulsification for 5 minutes in a homogenizer ("Ultratalax", trade name; product of IKA) and for 15 minutes in an ultrasonic bath, the emulsion was maintained at 70° C. for 15 hours in a flask while stirring.

As a result, a release agent particle dispersion (Wl) having a central particle diameter of 200 nm, melting point of 72° C. and a solid content of 20% was obtained.

<Preparation of Release Agent Particle Dispersion (W2)>

Anionic surfactant ("Neogen R", trade name; product of

| | |
|---|---|
| Daiichi Kogyo Seiyaku) | 2 parts by weight |
| Ion exchange water | 800 parts by weight |
| Carnauba wax | 200 parts by weight |

The above-described components were mixed and melted by heating to 100° C. The molten mixture was emulsified for 15 minutes in a homogenizer ("Ultratrax", trade name; product of IKA) and then, in a gaulin homogenizer at 100° C.

As a result, a release agent particle dispersion (W2) having a central particle diameter of 170 nm, melting point of 83° C. and a solid content of 20% was obtained.

EXAMPLE 1

Preparation of Toner Particles (1)

| | |
|---|---|
| Resin particle dispersion (1) | 315 parts by weight (resin: 63 parts by weight) |
| Colorant particle dispersion (P1) | 40 parts by weight (pigment: 8.6 parts by weight) |
| Release agent particle dispersion (W1) | 40 parts by weight (release agent: 8.6 parts by weight) |
| Poly(aluminum chloride) | 0.15 parts by weight |
| Ion exchange water | 300 parts by weight |

The above-described components were put into a round-bottom stainless flask according to the above-described formulation, and mixed and dispersed thoroughly in a homogenizer ("Ultratalax T50", trade name; product of IKA). The resulting dispersion was heated to 42° C. while stirring in the flask in an oil bath heater, and then kept at 42° C. for 60 minutes. To the resulting mixture was added 105 parts by weight (resin: 21 parts by weight) of the resin particle dispersion (1) and the resulting mixture was gently stirred.

Next, a 0.5 mole/liter aqueous solution of sodium hydroxide was added to adjust the pH in the system to 6.0. The dispersion was heated to 95° C. without stopping stirring. When the temperature is raised to 95° C., the pH in the system usually lowers to 5.0 or less. An aqueous sodium hydroxide solution was therefore added further and the lowering of pH to below 5.5 was avoided.

After completion of the reaction, cooling, filtration and sufficient washing with ion exchange water were carried out. Then, solid-liquid separation was effected through a Nutsche suction filter. After re-dispersion in 3 liters of ion exchange water of 40° C., the resulting dispersion was washed by stirring at 300 rpm for 15 minutes. The washing operation was repeated 5 times. The dispersion was subjected to solid-liquid separation through a Nutsche suction filter, followed by vacuum drying for 12 hours to yield toner particles (1).

As a result of measurement of the particle size of the toner particles (1) by a Coulter counter, it was found that the cumulative volume average particle size $D_{50}$ was 4.5 μm and the volume average particle size distribution index GSDv was 1.23. The shape factor SF1 of the toner particles as measured from the shape observation through LUZEX was 128, meaning that the toner particles (1) had a potato-like shape.

<Preparation of Toner (1) Having an External Additive Added Thereto and Developer (1)>

To 50 parts by weight of the above-described toner particles was added 1.5 parts by weight of hydrophobic silica ("TS720", trade name; product of Cabot). The resulting mixture was mixed in a sample mill to afford a toner (1) having an external additive added thereto.

A ferrite carrier having an average particle size of 50 μm and covered with 1% of polymethyl methacrylate (product of Soken Chemical, Mw: 75,000) and the toner having an external added thereto which had been weighed to give a toner concentration of 5% were mixed by stirring for 5 minutes in a ball mill to prepare a developer (1).

<Evaluation of Toner>

An image was formed by using the above-described developer in a remodeled "DocuCentre Color f450" (trade name; product of Fuji Xerox) in which a two-roll type fixing device had been remodeled to give the maximum fixing pressure of 1.2 MPa (12 kgf/cm$^2$).

As transfer paper, "mirror coat platinum paper" (256 g/m$^2$), that is, coated thick paper designated by Fuji Xerox was used and the fixing property of a toner was studied while adjusting the processing speed at 180 mm/sec. As a result, the toner showed a sufficient fixing property judging from the good oilless fixing property, and the lowest fixing temperature (the temperature was judged from the contamination of an image by rubbing the image with a cloth) of 110° C. or greater, and it also showed uniform gloss. Both of its developing property and transfer property were good and the image thus formed had high quality without defects (A).

Even at a fixing temperature of 180° C., occurrence of hot offset was not observed.

In the above-described remodeled machine, 50000 sheets of. paper were printed continuously in a laboratory environment, but the initial good image quality was maintained throughout the printing (maintenance at continuous test: A)

The toner (developer) was evaluated in the below-described criteria.

a. Lowest Fixing Temperature

The lowest temperature of a heating roller at which no defect occurs in a fixed image after rubbing the fixed image with a gauze cloth was designated as the lowest fixing temperature.

b. Image Quality

The thin line reproducibility of an image on which thin lines had been fixed and fog on a non-fixed portion (visual observation) were observed through a loupe and the image quality was judged based on the below-described criteria.

A: Thin lines are uniform and no fog is observed.

B: Slight unevenness is found in the image.

C: Unevenness exists in the image.

c: Hot Offset Occurrence Temperature

The fixing treatment was conducted using the above-described copier. Then, blank transfer paper was sent to the fixing device under similar conditions and visual observation whether the paper was stained with a toner or not was repeated while varying temperatures of the fixing device. The lowest temperature at which the paper was stained with the toner was designated as an offset occurrence temperature.

d. Maintenance at Continuous Test

Under laboratory conditions (23° C., 55% RH), 50,000 sheets of paper were printed continuously and they were evaluated based on the following criteria:

A: The initial good image was maintained throughout the printing.

B: Some deterioration in the image quality was observed.

C: Apparent deterioration in the image quality occurred.

e: Paper Curling

Paper curling after the above-described print test was evaluated based on the following criteria:

A: Curling scarcely occurred.

B: Curling slightly occurred but the sheet became flat with the passage of time.

C: Unrecoverable curling occurred.

EXAMPLE 2

In a similar manner to Example 1 except for the use of resin particle dispersion (2), release agent particle dispersion (W1), and colorant particle dispersion (P2) instead, a toner was prepared and evaluated. It exhibited a sufficient fixing property at 105° C. or greater when a fixing property on coated thick paper was observed.

EXAMPLE 3

In a similar manner to Example 1 except for the use of resin particle dispersion (3), release agent particle dispersion (W2), and colorant particle dispersion (P2) instead, a toner was prepared and evaluated.

(Evaluation of Toner)

An image was formed by using the above-described developer in a remodeled "DocuCentre Color f450" (trade name; product of Fuji Xerox), in which a two-roll type fixing device had been remodeled to give the maximum fixing pressure of 9.5 MPa (12 kgf/cm$^2$) by replacing a heating roll with a high hardness roll obtained by coating a SUS tube with tetrahydrofuran.

As transfer paper, "mirror coat platinum paper" (256 g/m$^2$), that is, coated thick paper designated by Fuji Xerox was used and the fixing property of a toner was studied while adjusting the processing speed at 180 mm/sec. As a result, the oilless fixing property was good, the lowest fixing temperature (the temperature was judged from the contamination of an image after rubbing the image with a cloth) was 90° C. or greater, and the image was fixed sufficiently. In addition, gloss was uniform. Both of its developing property and transfer property were good and the image thus formed had high quality without defects (A). At a fixing temperature of 180° C., occurrence of hot offset was not observed. In the above-described remodeled machine, 50,000 sheets of paper were printed continuously in a laboratory environment, but the initial good image quality was not lost throughout the printing (maintenance at continuous test: A)

COMPARATIVE EXAMPLE 1

An image was formed with the toner obtained in Example 3 by using a two-roll type fixing device remodeled by replacing a heating roll with a high hardness roll obtained by coating an SUS tube with tetrahydrofuran to give the maximum fixing pressure of 11.0 Mpa (12 kgf/cm$^2$).

The toner was evaluated as in Example 3. As a result, the lowest fixing temperature (judged by the contamination of the image after rubbing the image with a cloth) was 90° C. or greater and the image was fixed sufficiently and at the same time, the gloss was uniform. At a fixing temperature of 160° C., however, contamination of the image due to a hot offset phenomenon occurred and the paper was not suited for use because paper curling became severer after fixing and the paper did not become flat even after it was allowed to cool.

COMPARATIVE EXAMPLE 2

In a similar manner to Example 1 except for the use of resin particle dispersion (4) instead, a toner was prepared.

The above-described results are shown in Table 2.

TABLE 2

| | Ex. 1 | Ex. 2 | Ex. 3 | Comp. Ex. 1 | Comp. Ex. 2 |
|---|---|---|---|---|---|
| Resin particle dispersion | (1) | (2) | (3) | (3) | (4) |
| Colorant particle dispersion | (P1) | (P2) | (P1) | (P1) | (P1) |
| Release agent particle dispersion | (W1) | (W1) | (W2) | (W2) | (W1) |
| $D_{50}$ (μm) | 4.5 | 4.8 | 4.6 | 4.6 | 4.8 |
| GSDv | 1.23 | 1.22 | 1.21 | 1.21 | 1.22 |
| SF1 | 128 | 120 | 132 | 132 | 130 |
| Maximum fixing pressure (MPa) | 1.2 | 1.2 | 9.5 | 11.0 | 1.2 |
| Lowest fixing temperature (° C.) | 110 | 105 | 90 | 90 | 170 |
| Hot offset temperature (° C.) | 180≦ | 180≦ | 180≦ | 160 | 170 |
| Image quality | A | A | A | A | B |
| Maintenance at continuous test | A | A | A | A | B |
| Paper curling | A | A | A | C | C |

According to the invention, a highly reliable image forming method capable of fixing an image at normal temperature or by low temperature heating and forming a high quality image can be provided. In particular, according to the invention, a highly reliable image forming method capable of fix an image at normal temperature or by low temperature heating and form a high quality image even if thick paper is used can be provided. In addition, according to the invention, a production process of a toner for developing an electrostatic latent image suited for use in the image forming method can be provided.

The entire disclosure of Japanese Patent Application No. 2005-308042 filed on Oct. 24, 2005 including specification, claims and abstract is incorporated herein by reference in its entirety.

What is claimed is:

1. An image forming method, which comprises:

forming an electrostatic latent image on a surface of a latent image supporting member;

developing the electrostatic latent image formed on the surface of the latent image supporting member with a toner for developing an electrostatic latent image or an electrostatic latent image developer containing the toner and a carrier to form a toner image;

transferring the toner image formed on the surface of the latent image supporting member onto a surface of a transfer receiving material; and fixing the toner image transferred onto the transfer receiving material under pressure, wherein the toner comprises a resin, the resin comprising a block copolymer that consists of a crystalline polyester block and a non-crystalline polyester block, and the crystalline polyester has a crystal melting point of from 50 to 120° C.;

wherein a maximum pressure applied when the image is fixed is 1 MPa or greater but not greater than 10 MPa, and the resin exhibits a plastic behavior under the pressure; and wherein the block copolymer has a melting point of from 50 to 100° C.

2. The image forming method according to claim 1, wherein the crystalline polyester is a polyester obtained by at least one of a reaction between 1,9-nonanediol and 1,10-decanedicarboxylic acid; and a reaction between 1,6-hexanediol and sebacic acid.

3. The image forming method according to claim 1, wherein a weight ratio of the crystalline polyester block/the non-crystalline polyester block is from 1/20 to 20/1.

4. The image forming method according to claim 1, wherein the non-crystalline polyester has a glass transition point Tg of from 50 to 80° C.

5. The image forming method according to claim 1, wherein the block copolymer has a glass transition point of from 50 to 80° C.

6. The image forming method according to claim 1, wherein the block copolymer has a weight average molecular weight of from 5,000 to 500,000.

7. The image forming method according to claim 1, wherein a crystalline polyester resin that comprises the crystalline polyester block in the block copolymer has a weight average molecular weight of from 1,000 to 100,000.

8. The image forming method according to claim 1, wherein the toner comprises a release agent.

9. The image forming method according to claim 1, wherein inorganic particles are mixed with the toner or added to a surface of resin particles comprising the block copolymer.

10. The image forming method according to claim 9, wherein the inorganic particles have a primary particle diameter of from 5 nm to 2 μm.

11. The image forming method according to claim 1, wherein the toner for developing an electrostatic latent image is obtained by a method comprising:

aggregating, in a dispersion containing resin particles that comprises: a block copolymer having a crystalline polyester block and a non-crystalline polyester block; and release agent particles, the resin particles and the release agent particles, so as to obtain aggregated particles; and heating the aggregated particles to fuse into a coalescent body.

12. The image forming method according to claim 1, wherein the toner has a cumulative volume average particle size $D_{50}$ within a range of from 3.0 to 9.0 μm.

13. The image forming method according to claim 1, wherein the toner has a shape factor SF1 of from 100 to 140.

* * * * *